US005428323A

United States Patent [19]

Geissler et al.

[11] Patent Number: 5,428,323

[45] Date of Patent: Jun. 27, 1995

[54] DEVICE FOR COMPENSATING FOR TEMPERATURE-DEPENDENT VOLUME CHANGES IN A WAVEGUIDE

[75] Inventors: Klaus Geissler, Backnang; Jürgen Damaschke, Heilbronn; Dieter Wolk, Winterbach, all of Germany

[73] Assignee: ANT Nachrichtentechnik GmbH, Backnang, Germany

[21] Appl. No.: 261,326

[22] Filed: Jun. 16, 1994

[30] Foreign Application Priority Data

Jun. 16, 1993 [DE] Germany ..... 43 19 886.4

[51] Int. Cl.[6] ..... H01P 5/12; H01P 3/12

[52] U.S. Cl. ..... 333/135; 333/234

[58] Field of Search ..... 333/135, 202, 208, 227, 333/229, 239, 241, 248, 234

[56] References Cited

U.S. PATENT DOCUMENTS 3,034,078 5/1962 McCoubrey ..... 333/229

4,057,772 11/1977 Basil, Jr. et al. ..... 333/229

5,274,344 12/1993 Langer et al. ..... 333/135

FOREIGN PATENT DOCUMENTS 4113302 10/1992 Germany .

*Primary Examiner*—Seungsook Ham

*Attorney, Agent, or Firm*—Spencer, Frank & Schneider

[57] ABSTRACT

A waveguide assembly includes a waveguide having walls defining a cavity; and a frame surrounding the walls of the waveguide. The frame has a coefficient of thermal expansion less than that of the waveguide. First and second connecting spacers are attached to and project away from oppositely located wall portions of the waveguide and are attached to the frame such that forces derived from a difference between a heat expansion of the frame and a heat expansion of the waveguide are transmitted by the first and second connecting spacers to the waveguide walls for deforming the same.

7 Claims, 1 Drawing Sheet

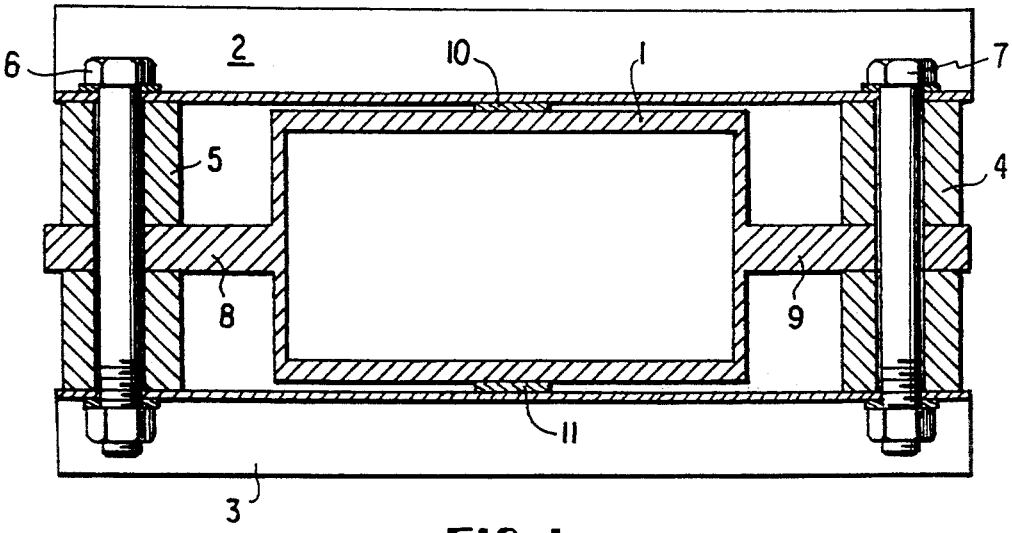
FIG. 1
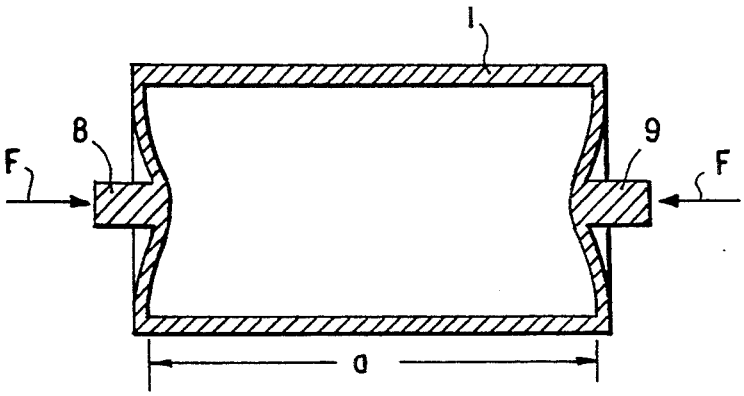
FIG. 2
FIG. 3
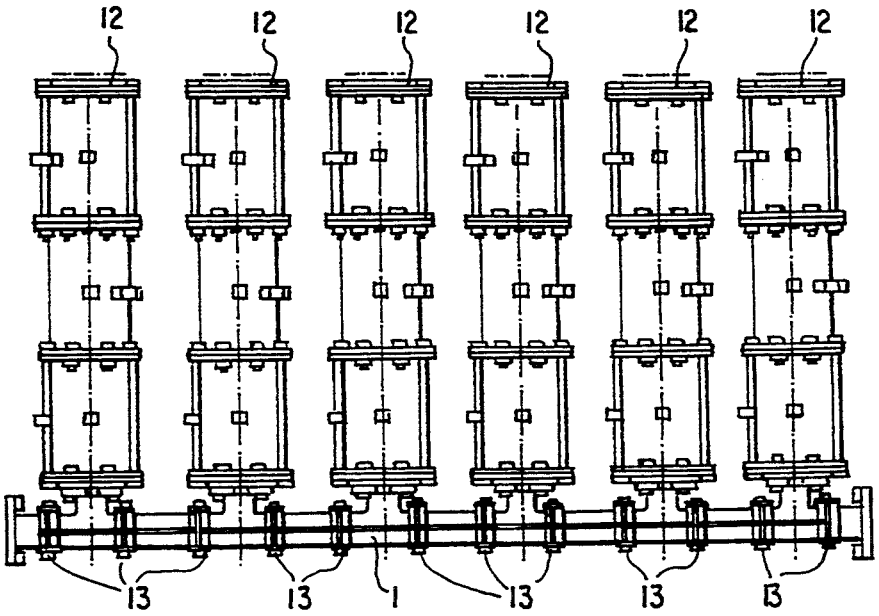

DEVICE FOR COMPENSATING FOR TEMPERATURE-DEPENDENT VOLUME CHANGES IN A WAVEGUIDE

CROSS REFERENCE TO RELATED APPLICATION

This application claims the priority of German Application No. P 43 19 886.4 filed Jun. 16, 1993, which is incorporated herein by reference.

BACKGROUND OF THE INVENTION

This invention relates to a device which compensates for temperature-dependent changes of a waveguide volume.

German Offenlegungsschrift (application published without examination) 41 13 302 discloses a device which compensates for temperature-dependent volume changes in a cavity resonator. Such volume changes cause shifts in the resonance frequency. The device has a yoke-like construction mounted over an end face of the cavity wall. The yoke has a greater coefficient of thermal expansion than the cavity resonator. The yoke is affixed at its two ends at the edge of the cavity wall and has such a length that upon installation a tension stress is generated therein which is transmitted by means of a block to the end face of the cavity wall. In this manner the cavity wall is submitted to a deformation that depends from the relative temperature-dependent expansions of the yoke and the cavity.

SUMMARY OF THE INVENTION

It is an object of the invention to provide an improved device of the above-outlined type which is capable of compensating for very large temperature-dependent changes of a waveguide volume.

This object and others to become apparent as the specification progresses, are accomplished by the invention, according to which, briefly stated, the waveguide assembly includes a waveguide having walls defining a cavity; and a frame surrounding the walls of the waveguide. The frame has a coefficient of thermal expansion less than that of the waveguide. First and second connecting spacers are attached to and project away from oppositely located wall portions of the waveguide and are attached to the frame such that forces derived from a difference between a thermal expansion of the frame and a thermal expansion of the waveguide are transmitted by the first and second connecting spacers to the waveguide walls for deforming the same.

Particularly in the space applications, extremely large temperature fluctuations occur which, dependent on the particular waveguide material, manifest themselves as significant volume changes of the waveguide elements. To counteract such effects, materials such as Invar may be used which have only a very small coefficient of thermal expansion. As compared to the conventionally used aluminum which has a large coefficient of thermal expansion, Invar, however, has the disadvantage that it is about three times heavier than aluminum and is significantly more difficult to shape with milling machines. Also, the heat conductivity of Invar is very low as compared to aluminum, which is a disadvantage for high power applications. Consequently, it takes complex measures to integrate extended Invar components into thermal spacecraft systems which utilize aluminum heat pipes.

The arrangement according to the invention makes it possible to compensate for very large thermal expansions of a waveguide so that aluminum may be used as basic waveguide material for space applications. The frame which, according to the invention surrounds the waveguide on all sides, affects simultaneously several wall regions and thus causes an elastic deformation of the waveguide cross section.

The device according to the invention may find application in particular in frequency multiplexer/demultiplexer (OMUX/IMUX) which conventionally includes a manifold waveguide to which band-pass filters are coupled. In such an OMUX/IMUX a temperature-dependent volume change of the manifold waveguide causes, on the one hand, a change of the waveguide wavelength and of the waveguide impedance and, on the other hand, causes a shift of the geometrical distances between the ports of the band-pass filters. Upon temperature increase the waveguide wavelength decreases and the distances between ports increases. That is: measured in waveguide wavelength, the distance between ports changes even more than derived simply from theory of thermal expansion. These effects, unless compensated for by the device according to the invention, lead to distortions of the transfer characteristics of the multiplexer/demultiplexer.

BRIEF DESCRIPTION OF THE DRAWINGS

FIG. 1 is a sectional view of a preferred embodiment of the invention applied to a waveguide.

FIG. 2 is a sectional view of a waveguide where the deformation effect caused by the device according to the invention is amplified.

FIG. 3 is a side view of the waveguide coupled with band-pass filters.

DESCRIPTION OF THE PREFERRED EMBODIMENT

FIG. 1 shows a cross section of a rectangular waveguide 1 clamped into a frame which surrounds the waveguide on all sides. The frame includes two braces 2 and 3 which may have a U-shaped cross section and which are secured to one another on either side of the waveguide 1 by bolts 6 and 7 surrounded by respective spacers 4 and 5. The waveguide is of a material, such as aluminum which has a greater coefficient of thermal expansion than the material (for example, Invar) of which at least parts of the frame 2, 3, 4 and 5 are made (spacers 4 and 5, may be of aluminum).

On two opposite walls of the waveguide 1 connecting spacers such as ribs 8 and 9 are provided which may either be integral parts of the waveguide or may be bonded or screwed thereon. The spacers 4, 5 of the frame are firmly attached to the ribs 8 and 9. The ribs 8 and 9 determine the distance between the frame and the waveguide walls.

Upon warming, the waveguide 1 and its ribs 8 and 9 expand relative to the frame 2, 3, 4, 5. As a result, as shown in FIG. 2, short walls of the waveguide 1 bend to the inside. The effective width of the waveguide is reduced. By virtue of the fact that the ribs 8 and 9 are of a material (for example, aluminum) which has a greater coefficient of thermal expansion than the material of the frame 2, 3, the width of the waveguide which determines the waveguide wavelength, is reduced relative to its normal dimension a in the non-expanded state of the waveguide. Conversely, in case of cooling of the waveguide system causes the short walls of the waveguide 1 to bend outward beyond the normal dimension a.

The forces F in the ribs 8, 9 thus counteract always the volume change of the waveguide 1 in such a manner that the waveguide wavelength varies at the same rate as the filter separation.

Between the braces 2 and 3 of the frame and the adjoining lateral walls of the waveguide 1 spacer wafers 10 and 11 may be inserted which counteract undesired bending of the long waveguide walls.

In the described embodiment the waveguide whose temperature-dependent volume changes are to be compensated for is of rectangular shape. It will be understood that the compensating device according to the invention may find application in waveguides with any desired cross-sectional configuration.

In case of substantial length of the waveguide, a plurality of frames according to the invention may be distributed along the longitudinal axis of the waveguide and secured thereto.

It will be understood that the above description of the present invention is susceptible to various modifications, changes and adaptations, and the same are intended to be comprehended within the meaning and range of equivalents of the appended claims.

FIG. 3 shows a side view of a frequency multiplexer/demultiplexer which includes a manifold waveguide 1 to which (for example six) conventional band-pass filters 12 tuned to different frequencies are coupled. There are a plurality (for example twelve) frames 13 (as described above) surrounding said walls of said manifold waveguide 1 at axially spaced intervals.

What is claimed is:

1. A waveguide assembly comprising (a) a waveguide having walls defining a cavity; said walls including oppositely located wall portions;

(b) a frame surrounding said walls of said waveguide; said frame having a coefficient of thermal expansion less than a coefficient of thermal expansion of said waveguide; and (c) first and second connecting spacers attached to and projecting away from said oppositely located wall portions; said first and second connecting spacers being attached to said frame such that forces derived from a difference between a thermal expansion of said frame and a thermal expansion of said waveguide are transmitted by said first and second connecting spacers to said walls for deforming said walls.

2. The waveguide assembly as defined in claim 1, wherein said wall portions have inner faces oriented towards said cavity and outer faces oriented away from said cavity; and further wherein said first and second connecting spacers are ribs attached to said outer faces of said wall portions.

3. The waveguide assembly as defined in claim 1, wherein said waveguide is aluminum and at least part of said frame is Invar.

4. The waveguide assembly as defined in claim 1, wherein said frame comprises (a) two braces extending transversely to a length dimension of said waveguide on opposite sides of said cavity;

(b) spacer members situated between said braces on opposite sides of said cavity for positioning said braces at a predetermined distance from one another; and (c) screws securing said braces to one another.

5. The waveguide assembly as defined in claim 1, wherein said walls have additional wall portions spaced from said frame; further comprising spacer wafers positioned between said additional wall portions and said frame in contact therewith.

6. The waveguide assembly as defined in claim 1, in combination with a multiplexer/demultiplexer; wherein said waveguide is a manifold waveguide of said multiplexer/demultiplexer; further comprising a plurality of band-pass filters tuned to different frequencies; said band-pass filters being laterally coupled to said manifold waveguide.

7. A waveguide assembly comprising (a) a waveguide having a longitudinal axis and walls defining a cavity; said walls including oppositely located wall portions;

(b) a plurality of frames surrounding said walls of said waveguide at axially spaced intervals; each said frame having a coefficient of thermal expansion less than a coefficient of thermal expansion of said waveguide; and (c) first and second connecting spacers associated with each said frame and attached to and projecting away from said oppositely located wall portions; said first and second connecting spacers being attached to a respective said frame such that forces derived from a difference between a thermal expansion of said respective frame and a thermal expansion of said waveguide are transmitted by said first and second connecting spacers to said walls for deforming said walls.

* * * * *